US005477696A

United States Patent [19]

Takahata et al.

[11] Patent Number: 5,477,696

[45] Date of Patent: Dec. 26, 1995

[54] CONTROL DEVICE FOR ABSORPTION CHILLER OR ABSORPTION CHILLER/HEATER

[75] Inventors: Shuhzo Takahata; Kunihiko Nakajima, both of Shiga, Japan

[73] Assignee: Kawaju Reinetsu Kogyo Kabushiki Kaisha, Shiga, Japan

[21] Appl. No.: 157,237

[22] Filed: Nov. 24, 1993

Related U.S. Application Data

[63] Continuation-in-part of Ser. No. 8,064, Jan. 19, 1993, which is a continuation of Ser. No. 776,402, Nov. 22, 1991, abandoned.

[30] Foreign Application Priority Data

| | | | |
|---|---|---|---|
| Apr. 10, 1990 | [JP] | Japan | 2-95884 |
| Apr. 10, 1990 | [JP] | Japan | 2-95885 |
| Apr. 9, 1991 | [WO] | WIPO | PCT/JP91/00467 |

[51] Int. Cl.[6] ..... F25B 15/00

[52] U.S. Cl. ..... 62/148; 62/141

[58] Field of Search ..... 62/141, 148, 476, 62/101

[56] References Cited

U.S. PATENT DOCUMENTS

| | | | |
|---|---|---|---|
| 3,626,711 | 12/1971 | Porter et al. | 62/141 |
| 4,251,997 | 2/1981 | Newton | 62/101 |
| 4,274,264 | 6/1981 | Andres | 62/148 |
| 4,328,679 | 5/1982 | Usui et al. | 62/141 |
| 4,454,726 | 6/1984 | Hibino et al. | 62/148 |
| 4,505,123 | 5/1985 | Kusakabe et al. | 62/148 |
| 4,596,122 | 6/1986 | Kantner | 62/141 |
| 4,691,525 | 9/1987 | Gelderloos | 62/101 |
| 5,138,846 | 8/1992 | Ogawa et al. | 62/148 |
| 5,224,352 | 7/1993 | Arima et al. | 62/141 |

FOREIGN PATENT DOCUMENTS

| | | | |
|---|---|---|---|
| 0161441 | 10/1982 | Japan | 62/148 |

*Primary Examiner*—Henry A. Bennet
*Assistant Examiner*—William C. Doerrker
*Attorney, Agent, or Firm*—Lowe, Price, LeBlanc & Becker

[57] ABSTRACT

A temperature $t_{hg}$ of a solution 23*a* heated and concentrated in a generator 5, an outlet temperature $t_r$ of chilled water 21*a* flowed from an evaporator 1, and an outlet temperature $t_r$ of a flow of cooling water 22 fed from an absorber 2 to a condenser 4 are detected. A maximum allowable heating quantity Q* of generator 5 is calculated by means of a temperature $t_{hg}$, $t_r$ and $t_c$. A present heating quantity Q of generator 5 is controlled so as not to exceed a calculated maximum allowable heating quantity Q*. It is possible to prevent a heating quantity of the generator 5 from being excessively restricted and to prevent solution 23*a* from crystallizing at an outlet 6*a* of the heat exchanger 6. Further, loss of heat which occurs owing to returning generated refrigerant 24 to the concentrated solution 23*a* is obviated.

4 Claims, 4 Drawing Sheets

CONTROL DEVICE FOR ABSORPTION CHILLER OR ABSORPTION CHILLER/HEATER

This is a Continuation-In-Part of U.S. application Ser. No. 08/008,064, filed on Jan. 19, 1993, which is a continuation of U.S. application Ser. No. 07/776,402, filed on Nov. 22, 1991, and now abandoned.

TECHNICAL FIELD OF THE INVENTION

This invention relates to control device for an absorption or an absorption chiller/heater, more particularly, to a device for adjusting an opening degree of a burning quantity control valve which controls heat supplied to a generator in order to control the amount of heat provided to a solution therein during cooling cycle operation.

BACKGROUND OF THE INVENTION

In an absorption chiller or an absorption chiller/heater, the concentration of a liquid solution varies during circulation thereof in a vacuum vessel, and the variation of concentration generates chilled water or hot water to be introduced in to heat exchangers installed in rooms air-conditioned. The solution contains an absorbent, e.g., lithium bromide, lithium chloride, lithium iodide or the mixture thereof.

A single effect absorption machine has an evaporator, an absorber, a generator and a condenser in a vacuum vessel. As shown in FIG. 1 a double effect absorption machine has a high temperature generator 5 in another vacuum vessel besides above mentioned evaporator 1, absorber 2, low temperature generator 3 and condenser 4 in a main vessel.

An evaporator tube 1A is disposed in the evaporator 1. Refrigerant 24 in a refrigerant reservoir 1B is pressurized by a refrigerant pump 14 and is sprayed over the surface of evaporator tube 1A. As internal pressure in the vacuum vessel is extremely low, refrigerant 24 on the outer surface of evaporator tube 1A is evaporated by the heat of water 21 which passes through evaporator tube 1A. On the other hand the heat of vaporization of refrigerant 24 cools the water 21 in evaporator tube 1A. The water 21, i.e., chilled water 21*a* is introduced into heat exchangers (not illustrated) installed in rooms air-conditioned. The chilled water 21*a* is heat-exchaged with air in rooms by the heat exchangers. The chilled water 21*b* heat-exchanged is returned to the evaporator tube 1A by a chilled water pump 13. A pipe for introducing chilled water 21*a* into heat exchangers is provided with a temperature sensor 8 in order to detect an outlet temperature of the chilled water 21*a*.

An absorber 2 has an absorber tube 2A therein. The refrigerant vapor 20*b* generated in an evaporator 1 flows into the absorber 2. When sprayed solution 23*a* absorbs refrigerant vapor 20*b*, absorption heat is generated in the absorber 2. Since the absorption heat increases a temperature of concentrated solution 23*a*, the capacity which concentrated solution 23*a* absorbs refrigerant vapor 20*b* decreases. In order not to decrease the capability of absorbing refrigerant vapor 20*b*, cooling water 22 is fed to the absorber tube 2A. As the concentrated solution 23*a* is cooled, the solution recovers its capability to absorb refrigerant vapor 20*b*. The concentrated solution 23*a* absorbs much refrigerant vapor 20 so that a pressure in a vacuum vessel is kept at high vacuum. This absorber 2 is provided with a solution pump 15 to supply solution 23 in a solution reservoir 2B to low temperature generator 3.

A low temperature generator 3 is provided with a generator tube 3A into which refrigerant vapor 20*a* separated in a vapor separator 20 downstream a high temperature generator 5 is introduced. The dilute solution 23 supplied to the low temperature generator 3 by a solution pump 15 is heated by refrigerant vapor 20*a*. The refrigerant vapor 20*c* evaporated from dilute solution 23 in a low temperature generator 3 flows in to a condenser 4.

A high temperature generator 5 is provided with a heating device 9 by which solution 23*b* in a high temperature generator 5 is heated. The solution 23*b* heated under high vacuum is concentrated so that water vapor is generated from solution 23*b* as refrigerant vapor 20*a*.

A condenser 4 has a condenser tube 4A therein into which cooling water 22 after passing through an absorber tube 2A is introduced continuously. The refrigerant vapor 20*a* flowed from generator tube 3A and refrigerant vapor 20*c* evaporated in a low temperature generator 3 are cooled by a cooling water 22 which flows in a condenser tube 4A. The refrigerant vapor 20*a* and 20*c* are condensed into refrigerant 24.

Passage of cooling water 22 from an absorber tube 2A to a condenser tube 4A rises a temperature of cooling water 22, which is discharged from a condenser tube 4A so that it i cooled by a cooling tower (not illustrated) and is returned to the absorber tube 2A by a cooling water pump 12.

The absorption chiller/heater can perform not only above mentioned cooling operation but heating operation. Under cooling operation a cooling/heating switch valve 28 is closed. On the other hand under heating operation the switch valve 28 is opened.

Under both cooling operation and heating operation high temperature refrigerant vapor 20*a* from a vapor separator 20 is introduced into a low temperature generator 3. Alternatively, high temperature steam is introduced into a low temperature genera for 3 from a separately provided steam generator (not illustrared). High temperature refrigerant vapor 20*a* or high temperature steam heats dilute solution 23 in a low temperature generator 3. In the high temperature generator 5, fuel gas, e.g., town gas, LPG gas and natural gas or oil is burnt by a heating device 9. Alternatively, high temperature steam is introduced into a high temperature generator 5 from a separately provided steam generator. By combustion of fuel gas or oil or by the heat of high temperature steam the solution 23*b* in a high temperature generator 5 is heated.

The cooling capability of an absorption chiller or an absorption chiller/heater depends on a temperature of the chilled water 21*b* returned to an evaporator tube 1A or on a temperature of the chilled water 21*a* flowed out evaporator tube 1A and on a temperature of the cooling water 22 which is fed from absorber tube 2A to condenser tube 4A. For example, notwithstanding the fact that a temperature of the cooling water 22 is slow, when a temperature of the chilled water 21*a* detected by a temperature sensor 8 is higher than that of controlling target, a heating quantity of the high temperature generator 5 is adjusted by subjecting to a proportional control or a PID (proportional, integral and differential) control which is based on an outlet temperature of the chilled water 21*a*, so that an opening degree of the burning quantity control valve 10 is increased, and solution 23*b* in a high temperature generator 5 is heated up. A large quantity of refrigerant vapor 20*a* is generated from solution 23*b*, which is concentrated more.

As described above, when a temperature of cooling water 22 is low, dilute solution 23 in the solution reservoir 2B of absorber 2 falls in temperature. As concentrated solution 23*a* which is introduced into the low temperature heat exchanger 6 through a high temperature heat exchanger 7 from the vapor separator 20 is cooled by the dilute solution 23 supplied to the low temperature heat exchanger 6 by a solution pump 15. According to strongly cooling the solution the absorbent crystallizes from the concentrated solution 23*a*. When the crystallized absorbent is deposited on the outlet 6*a* of a low temperature heat exchanger 6, choking at the outlet 6*a* thereof occurs. As a result, the absorption chiller or the absorption chiller/heater becomes inoperable.

In order to maintain a normal operation of an absorption chiller or an absorption chiller/heater, the following methods are adopted.

One method is to limit a heating quantity in the heating device 9 so that it is not more than a maximum heating quantity determined based on a temperature of the cooling water 22. Thereby the concentrated solution 23*a* introduced into the low temperature heat exchanger 6 is prevented from being excessively concentrated.

To state for reference, a single effect absorption machine is provided with neither high temperature generator 5 nor high temperature heat exchanger 7. In case of applying the above mentioned method of limiting a heating quantity to the single effect absorption machine, the amount of the steam supplied to a generator tube 3A from as team generator is limited.

However, cooling operation of an absorption chiller or an absorption chiller/heater depends on not only a temperature of the cooling water 22 but a temperature of the water 21 in the evaporator tube 1A, a temperature of the concentrated solution 23*a* and a heating quantity of the heating device 9. If the above mentioned method is adopted, the heating quantity which is suitable for any operating condition may not often be obtained, and the concentration of concentrated solution 23*a* becomes insufficient to any desired operation.

Another method is to return the amount of refrigerant 24 determined according to a temperature of the dilute solution 23 in an absorber 2 from a condenser 4 to the refrigerant reservoir 1B of an evaporator 1, to the solution reservoir 2B of the absorber 2 or to a low temperature heat exchanger 6 through an unshown solenoid valve.

Returning refrigerant 24 to the refrigerant reservoir 1B or to the solution reservoir 2B may reduce concentration of the circulating solution in whole. The concentration of the concentrated solution 23*a* in a low temperature heat exchager 6 can be also reduced by returning refrigerant 24 to the low temperature heat exchanger 6. In both cases over-concentrating solution and crystallizing absorbent are able to supressed, however, the heating quantity which is used to generate returned refrigerant 24 is wasted.

It is thus an object of the present invention to provide a heating quantity suitable for an allowable operating condition of an absorption chiller or an absorption chiller/heater even when conditions of the cooling operation thereof vary, thereby making it possible that the concentration of solution introduced into a heat exchanger is controlled so as to match with any cooling operation, and preventing a part of heating quantity consumed for generating refrigerant from being wasted.

SUMMARY OF THE INVENTION

This invention relates to a control device for an absorption chiller or an absorption chiller/heater under cooling operation so as to obtain chilled water by heat of vaporization of the refrigerant separated from the solution during the repetition of concentration and dilution of the solution which circulates through an evaporator, an absorber, a generator and a condenser, comprising;

detector means for sensing a temperature of solution heated and concentrated in the generator, detector means for sensing an inlet or an outlet temperature of chilled water flowed into or from the evaporator, detector means for sensing an inlet or an outlet temperature of cooling water which is fed from the absorber to the condenser, detector means for picking up an opening degree of the burning quantity control valve which supplies heat source to said generator to obtain a present heating quantity of machine in operation.

In a first preferred embodiment there is also provided a control means for determining a maximum allowable value of the heating based on the sensed temperature of the heated solution, said one of said inlet or outlet temperatures the chilled water flow and one of the inlet or outlet temperatures of the cooling water, and for adjusting an opening degree of the control valve so that said rate of supply of heat to the generator does not exceed a calculated maximum allowable heating quantity thereof.

In a second preferred embodiment there is provided a control means accompanied with memory means for regulating a maximum allowable heating quantity of a generator. The control means is for calculating a maximum allowable temperature of the solution heated and concentrated in a generator based on a maximum allowable heating quantity thereof, one of an inlet or an outlet temperature of the chilled water, and one of the inlet or outlet temperatures of the cooling water, and for adjusting an opening degree of the control valve so that a temperature of the solution heated and concentrated in said generator does not exceed a calculated maximum allowable temperature thereof.

The third embodiment is provided with a control means for calculating a maximum allowable rate of providing heat to a generator based on a difference between a temperature of the solution and one of an inlet or an outlet temperature of the cooling water, and a difference between an inlet or an outlet temperature of the cooling water and an inlet or an outlet temperature of the chilled water, and for adjusting an opening degree of the control valve so that a present heating quantity of a generator does not exceed a calculated maximum allowable heating quantity thereof.

The four embodiment this provided with control means accompanied with memory means for regulating the maximum allowable heating quantity of the generator. The control means is for calculating a maximum allowable difference between a temperature of the solution heated and concentrated in the generator and one of an inlet or an outlet temperature of the cooling water based on a maximum allowable heating quantity of a generator and a difference between an inlet or an outlet temperature of the cooling water and a corresponding one of the outlet temperature of the chilled water, and for adjusting an opening degree of the burning quantity control valve so that a present difference between a temperature of the solution heated and concentrated in the generator and one of the inlet or an outlet temperature of the cooling water does not exceed a calculated maximum allowable difference thereof.

As a result, the absorbent is unlikely to crystallize in the concentrated solution, and the outlet of the heat exchanger is prevented from being choked with crystallized absorbent. Even when the conditions of cooling operation of an absorption chiller or an absorption chiller/heater vary, the heating quantity suitable for the operating conditions thereof is obtainable in the generator. Accordingly, the concentration of the solution obtained by the generator is controlled so as to be suitable for the cooling operation. In addition, as the generated refrigerant is not directly returned to the solution, the whole of heating quantity consumed for generating refrigerant is effective for the cooling operation.

For example, what a temperature of the chilled water becomes higher than an aimed temperature thereof in spite that a temperature of the cooling water is desirably low means an abnormal operation of an absorption chiller or an absorption chiller/heater. This abnormal operation occurs in the case that air has invaded into the vacuum vessel. In this case it is necessary to repair the machine, but if operation under the above mentioned control is forced to continue, the concentrated solution crystallizes at an outlet of a low temperature heat exchanger, as described above.

If an abnormal operation of an absorption chiller or an absorption chiller/heater is stopped, air-conditioning in rooms can not be quite performed. It is desired that an operation of the machine is continued till repair thereof even if an operation is abnormal. According to the present invention it enables to control the machine so that concentrated solution does not crystallized at an outlet of a low temperature heat exchanger under a provisional and abnormal operation thereof.

DETAILED DESCRIPTION OF THE INVENTION

Figure 1:
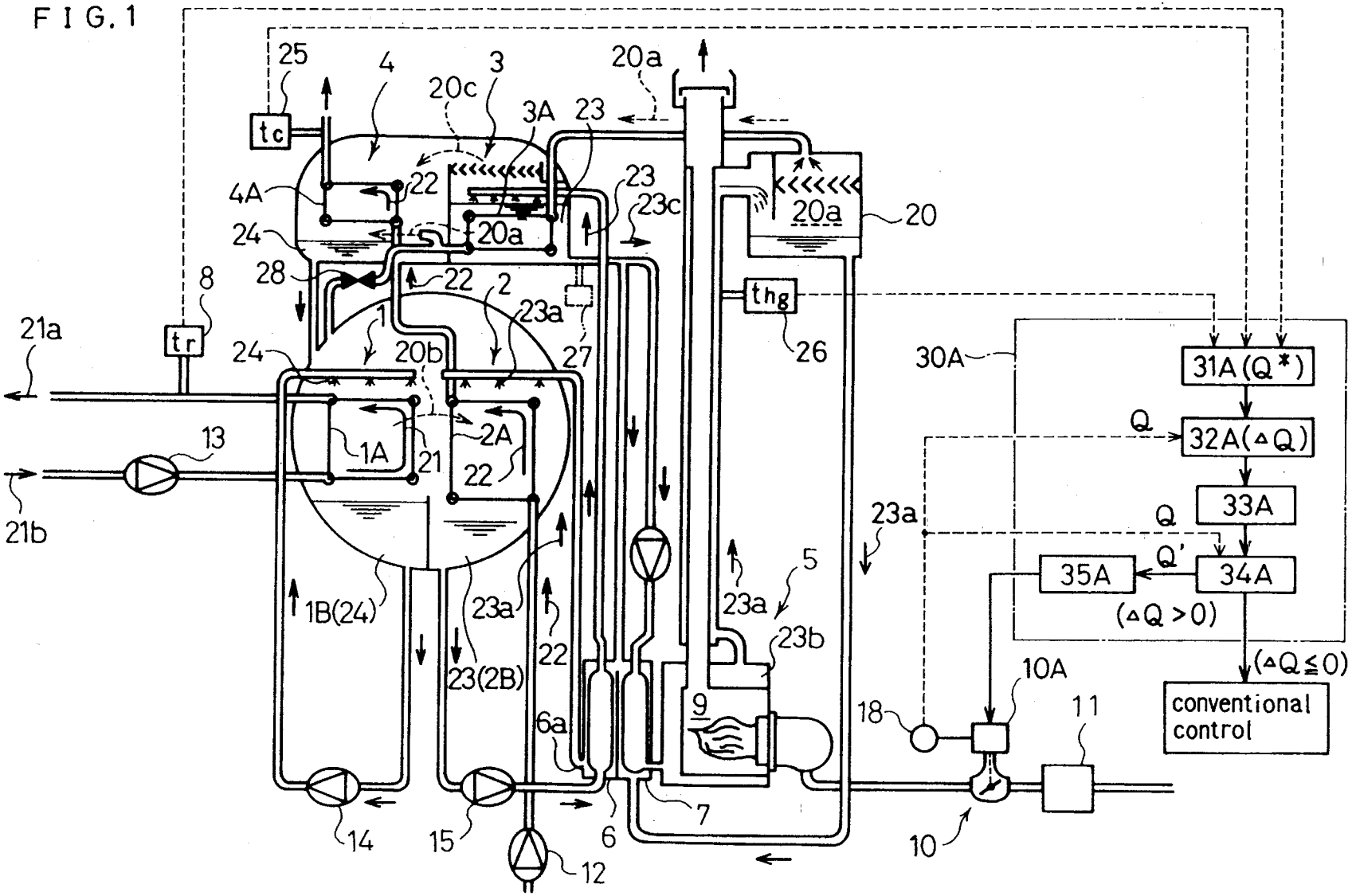
FIG. 1 is a first control system diagram of an absorption chiller/heater to which the present invention is applied.

FIG. 1 is of a system diagram showing an embodiment of a double effect absorption chiller/heater performing a cooling and/or heating operation, in which a chilled water flow 21*a* for cooling is generated in an evaporator tube 1A disposed in an evaporator 1 by means of variation of the concentration of aqueous solution including such as lithium bromide circulating in a main vacuum vessel. In an unshown absorption chiller, however, cooling operation only is performed. Followings is a description of the cooling operation of an absorption chiller/heater. An explanation of the cooling operation of an absorption chiller having the same general function as the absorption chiller/heater is omitted.

On the pipe for taking out chilled water 21*a* from the evaporator tube 1A a temperature sensor 8 for detecting a temperature $t_r$ of chilled water 21*a* is installed. At the outlet of the condenser tube 4A connected with the absorber tube 2A a temperature sensor 25 for detecting an outlet temperature $t_c$ of the cooling water 22 is installed. Further, at a high temperature generator 5 in another vacumm vessel or on the pipe between the high temperature generator 5 and a vapor separator 20 a temperature sensor 26 for detecting a temperature $t_{hg}$ of the concentrated solution 23*a* heated and concentrated by a heating device 9 is installed.

In the high temperature generator 5 is installed a calorie meter (not illustrated), a flow rate meter (not illustrated) for measuring amount of heat source such as fuel gas, oil or high temperature steam, or a valve opening detector 18 of the burning quantity control valve 10 in order to measure or calculate a present heating quantity Q of the high temperature generater 5. A numeral of 11 indicates a fuel shut off valve.

Under cooling operation of an absorption chiller/heater there is a certain functional relation among a temperature $t_r$ of the chilled water 21*a*, an outlet temperature $t_c$ of the cooling water 22, a temperature $t_{hg}$ of concentrated solution 23*a* and a heating quantity Q* of the high temperature generator 5. The relation is able to be expressed formulatedly such as a following equation:

$$Q^*=F_1(t_r, t_c, t_{hg}) \quad (1)$$

This equation is also expressed as follows;

$$Q^*=(t_{hg}+k_1\cdot t_c+k_2\cdot t_r+k_3)/(k_4\cdot t_c+k_c+k_5\cdot t_r+k_6) \quad (1)'$$

where $k_1$, $k_2$, $k_3$, $k_4$, $k_5$ and $k_6$ are constant.

Control means 30A is provided for calculating a maximum allowable heating quantity of the high temperature generator 5 based on a temperature $t_{hg}$ of the solution 23*a*, an outlet temperature $t_r$ of the chilled water 21*a* and an outlet temperature $t_c$ of the cooling water 22, and for adjusting an opening degree of the burning quantity control valve 10 so that a present heating quantity Q of the high temperature generator 5 does not exceed a calculated maximum allowable heating quantity Q* thereof.

Control means 30A is composed of calculating means 31A of Q*, calculating means 32A of ΔQ, comparator 33A, calculating means 34A of Q' and servo-driver means 35A, which are in a microcomputer. The calculating means 31A computes a maximum allowable heating quantity Q* of the high temperature generator 5 according to equation (1)' by receiving signals from detector means 26, detector means 8 and detector means 25.

The calculating means 32A obtains a difference ΔQ=Q−Q* between a calculated maximum allowable heating quantity Q* and a present heating quantity Q of high temperature generator 5 indirectly detected by a valve opening detector 18 of the burning quantity control valve 10. The comparator 33A checks whether a difference ΔQ is less than or equal to 0 or positive. The calculating means 34A calculates an aimed value Q' for adjusting cooling operation by means of detected Q when ΔQ>0, and orders a conventional controlled operation as when ΔQ≦0.

Above mentioned Q' is adopted in present embodiment as follows:

$$Q'=[1-k(\Delta Q/Q)]\cdot Q$$

where k is constant. This equation means that Q' increases linearly when ΔQ decreases.

The servo-driver means 35A outputs a signal to the actuator 10A so that an opening degree of the burning quantity control valve 10 is decreased according to Q'.

Controlling absorption chiller/heater under cooling operation is achieved as follows:

An outlet temperature $t_r$ of the chilled water 21*a*, an outlet temperature $t_c$ of the cooling water 22 and a temperature $t_{hg}$ of the concentrated solution 23*a* are detected by temperature sensors 8, 25 and 26 respectively. A suitable heating quantity, i.e., maximum allowable heating quantity Q' of the high temperature generator 5 is calculated from the equation (1)' in calculating means 31A.

On the other hand, a present heating quantity Q of the high temperature generator 5 is measured by a calorie meter. Alternatively a flow rate of the heat source is measured by the flow rate meter or by the valve opening detector 18 of the burning quantity control valve 10, which is converted into a heating quantity Q in the calculating means 31A.

When a suitable heating quantity Q*≧ a present heating quantity Q, i.e., ΔQ≦0, a present heating quantity is adjusted by subjecting to a proportional control or a PID control which is based on an outlet temperature $t_r$ of the chilled water 21*a* as stated in the paragraph of the background art of the present invention.

When a suitable heating quantity Q*< a present heating quantity Q, i.e.ΔQ>0, a present heating quantity in the heating device 9 is decreased till a suitable heating quantity Q* in order to prevent the machine from operating more abnormally. An optimum or allowable cooling operation is achieved without wasteful consumption of the heat source.

Above mentioned temperatures and a flow rate of the heat source are sampled every several seconds by the temperature sensors 8, 25, 26 and the valve opening detector 18. By means of those detected and measured values, the heating quantity is adjusted so as to match with the condition of a desired cooling operation, for example, every two minutes. In the machine which fuel gas or oil is burnt the degree of combustion thereof in the heating device 9 is adjusted. In the machine to which high temperature steam is supplied the amount of steam fed to the high temperature generator 5 is adjusted.

With respect to the above mentioned temperature $t_r$, an inlet temperature of the chilled water 21 flowed into evaporator 1 is available instead of an outlet temperature of the chilled water 21 flowed from evaporator 1. With respect to the above mentioned temperature $t_c$, too, an inlet temperature of the cooling water 22 taken in to absorber 2 may be adopted instead of an outlet temperature of the cooling water 22 flowed from condenser 4. Accordingly, any case of the combination I to IV as shown a following table is available.

| case | $t_r$ of chilled water | $t_c$ of cooling water |
|---|---|---|
| I | outler | outlet |
| II | outlet | inlet |
| III | inlet | outlet |
| IV | inlet | inlet |

The above mentioned equation (1) can be modified to the following one:

$$t_{hg}^*=F_2(t_r, t_c, Q^*) \quad (2)$$

This equation is also expressed as follows;

$$t_{hg}^*=k_1\cdot t_c+k_2\cdot t_r+(k_3\cdot t_c+k_4\cdot t_r+k_5)\ Q^*+k_6 \quad (2)'$$

where, $k_1$, $k_2$, $k_3$, $k_4$, $k_5$ and $k_6$ are constant.

It is often requested to carry out the operation which a maximum allowable heating quantity of the high temperature generator 5 is previously set lower so as to enable other desired cooling operation. At such an opportunity, e.g., 0.8 times a maximum allowable heating quantity is selected as a suitable heating quantity Q* in equation (2)'. By means of an outlet temperature $t_r$ of the chilled water 21*a* and an outlet temperature $t_c$ of the cooling water 22 detected by the temperature sensors 8 and 25 respectively, a suitable temperature $t_{hg}$* of the solution of the high temperature generator 5 is calculated based on the equation (2)'. On the other hand, the temperature $t_{hg}$ of the concentrated solution 23*a* in the high temperature generator 5 is detected by the temperature sensor 26.

Figure 2:
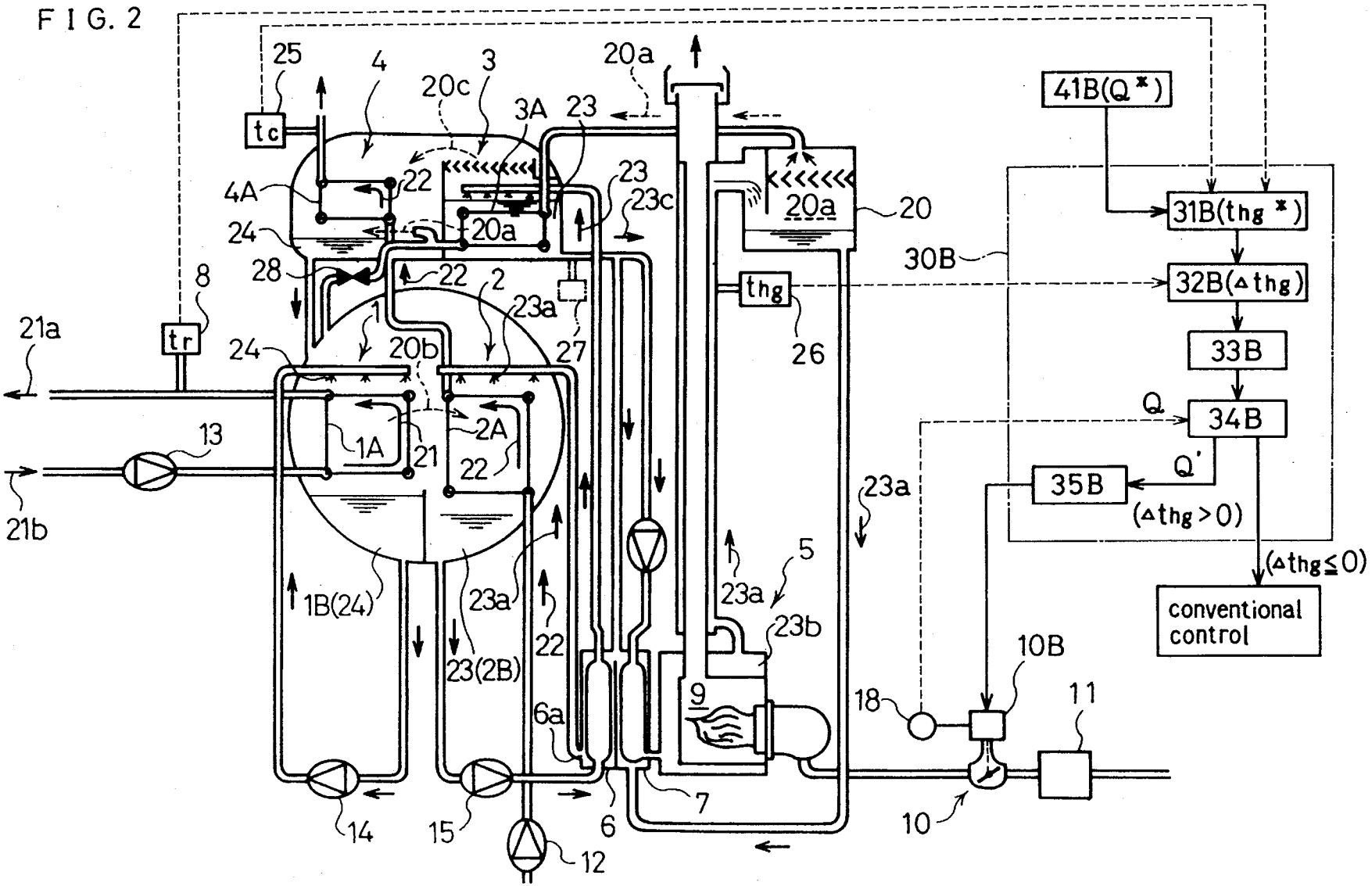
FIG. 2 is a second control system diagram of an absorption chiller/heater to which the present invention is applied.

In this embodiment of FIG. 2 the device compises a valve opening detector 18 and control means 30B accompanied with memory means 41B into which a desirable predetermined Q* is inputted by an operator. The control means 30B is provided for calculating a maximum allowable temperature $t_{hg}$* of the solution 23*a* heated and concentrated in a generator 5 based on a maximum allowable heating quantity Q* of the generator 5, an outlet temperature $t_r$ of the chilled water 21*a* and an outlet temperature $t_c$ of the cooling water 22, and for adjusting an opening degree of the burning quantity control valve 10 so that a temperature $t_{hg}$ of the solution 23*a* heated and concentrated in the generator 5 does not exceed a calculated maximum allowable temperature $t_{hg}$* thereof.

The control means 30B consists of calculating means 32B for $\Delta t_{hg}=t_{hg}-th_{hg}$*, comparator 33B for distinguishing whether $\Delta t_{hg}\leqq 0$ or not, calculating means 34B for calculating an aimed value Q' for adjusting the operation by using detected Q when $\Delta t_{hg}>0$ and for ordering the conventional controlled operation when $\Delta t_{hg}\leqq 0$ and servo-driver means 35B to an actuator 10B so that valve 10 is closed according to Q'. An equation for calculating Q' is adopted as follows.

$$Q'=[1-k\cdot\Delta t_{hg}]\cdot Q$$

where k is constant. This equation means that Q* increases linearly when $\Delta t_{hg}$ decreases.

The servo-driver means 35B outputs a signal to an actuator 10B so that an opening degree of the burning quantity control valve 10 is decreased according to Q'.

When a suitable temperature $t_{hg}$* of the solution in the high temperature generator ≧ a present temperature $t_{hg}$ of the solution in the high temperature generator 5, i.e., $\Delta t_{hg}\leqq 0$, a heating quantity of the heating device 9 is adjusted by subjecting to a proportional control or a PID control which is based on an outlet temperature $t_r$ of the chilled water 21*a* as stated in a paragraph of the background art.

When a suitable temperature $t_{hg}$* of the solution in the high temperature generator < a present temperature $t_{hg}$ of the solution in the high temperature generator 5, i.e., $\Delta t_{hg}>0$, a present heating quantity Q in the heating device 9 is decreased so that a present temperature $t_{hg}$ of the solution in the high temperature generator 5 becomes less than a suitable temperature $t_{hg}$* thereof in order to prevent the machine from operating more abnormally. An optimum cooling operation is performed without wasteful consumption of the heat source in the limited operation range.

Changing a view point, under a proper cooling operation of an absorption chiller/heater there is another functional relation among $t_{hg-tc}$ which is a difference between a temperature $t_{hg}$ of the concentrated solution 23*a* and an outlet temperature $t_c$ of the cooling water 22, $t_c-t_r$ which is a difference between an outlet temperature $t_c$ of the cooling water 22 and an outlet temperature $t_r$ of the chilled water 21 and a maximum allowable heating quantity Q*. The relation is able to be expressed formulatedly such as a following equation:

$$Q^*=F_3(t_{hg}-t_c,\ t_c-t_r) \quad (3)$$

This equation is also expressed as follows;

$$Q^*=(t_{hg}-t_c)+k_1\cdot(t_c-t_r)+k_2]/[k_3\cdot(t_c-t_r)+k_4] \quad (3)'$$

where $k_1$, $k_2$, $k_3$ and $k_4$ are constant.

Figure 3:
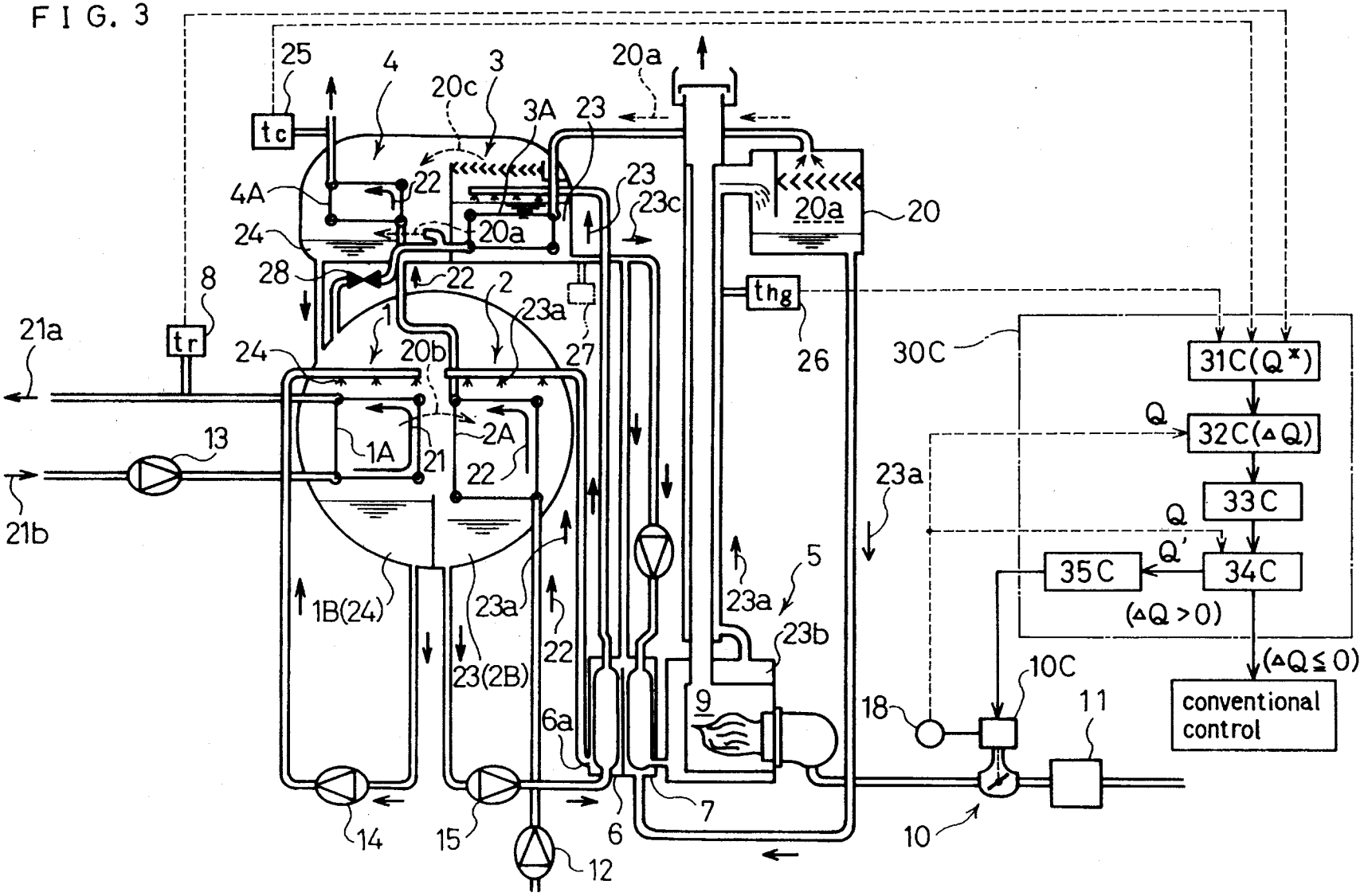
FIG. 3 is a third control system diagram of an absorption chiller/heater to which the present invention is applied.

As shown in FIG. 3 control means 30C is provided for calculating a maximum allowable heating quantity Q* of the generator 5 based on a difference $t_{hg}-t_c$ between a temperature $t_{hg}$ of the solution 23*a* and an outlet temperature $t_c$ of the cooling water 22 and a difference $t_c-t_r$ between an outlet temperature $t_c$ of the cooling water 22 and an outlet temperature $t_r$ of the chilled water 21*a*, and for adjusting an opening degree of the burning quantity control valve 10 so that a present heating quantity Q of the generator 5 does not exceed a calculated maximum allowable heating quantity Q* thereof.

This control means 30C consists of calculating means 31C for Q*, calculating means 32C for $\Delta Q=Q-Q^*$ by using detected Q, comparator 33C for $\Delta Q \leqq 0$ or $\Delta Q>0$, calculating means 34C for calculating an aimed value Q' for adjusting an operation by using detected Q when $\Delta Q>0$, and for ordering a conventional controlled operation when $\Delta Q \leqq 0$, and servo-driver means 35C to an actuator 10C so that the valve 10 is closed according to Q'. An equation for calculating Q' is adopted in the embodiment as follows.

$$Q'=[1-k(\Delta Q/Q)]\cdot Q$$

where k is constant. This equation means that Q' increases linearly when ΔQ decreases.

An outlet temperature $t_r$ of the chilled water 21*a*, an outlet temperature $t_c$ of the cooling water 22, and a temperature $t_{hg}$ of the concentrated solution 23*a* are detected by temperature sensors 8, 25 and 26 respectively. A maximum allowable heating quantity Q* of the high temperature generator 5 is calculated from the equation (3)'.

On the other hand, a present heating quantity 0 of the high temperature generator 5 is measured by a calorie mater or a valve opening detector 18 of the burning quantity control valve 10 in order to calculate the heating quantity.

When a maximum allowable heating quantity $Q^* \geqq$ a present heating quantity Q, i.e., $\Delta Q \leqq 0$, a heating quantity is adjusted by subjecting to a proportional control or a PID control which is based on the outlet temperature $t_r$ of the chilled water 21*a* as stated in the paragraph of the background art.

When a maximum allowable heating quantity $Q^*<$ a present heating quantity Q, i.e., $\Delta Q>0$, a present heating quantity Q in the heating device 9 is decreased till a suitable heating quantity, i.e., till a maximum allowable heating quantity Q* in order to prevent the machine from operating more abnormally. An optimum cooling operation is achieved without wasteful consumption of the heat source.

The above mentioned equation (3) can be modified to the following one:

$$(t_{hg}-t_c)^*=F_4(t_c-t_r, Q^*) \quad (4)$$

This equation is also expressed as follows;

$$(t_{hg}-t_c)^*=(k_1+k_2\cdot Q^*)\cdot(t_c-t_r)+k_3\cdot Q^*+k_4 \quad (4)'$$

where $k_1$, $k_2$, $k_3$ and $k_4$ are constant.

It is often requested to carry out an operation which a maximum allowable heating quantity in the high temperature generator 5 is previously set lower so as to enable other desired cooling operation. At such an opportunity, e.g., 0.8 times a maximum allowable heating quantity is selected as a suitable heating quantity Q* in the equation (4)'. By means of an outlet temperature $t_r$ of the chilled water 21*a* and an outlet temperature $t_c$ of the cooling water 22 detected by temperature sensors 8 and 25 respectively, a difference $(t_{hg}-t_c)^*$ between a temperature of the concentrated solution 23*a* and an outlet temperature of the cooling water 22 is calculated based on the equation (4)'. On the other hand, temperature $t_{hg}$ of an concentrated solution 23*a* and an outlet temperature $t_c$ of the cooling water 22 is detected.

Figure 4:
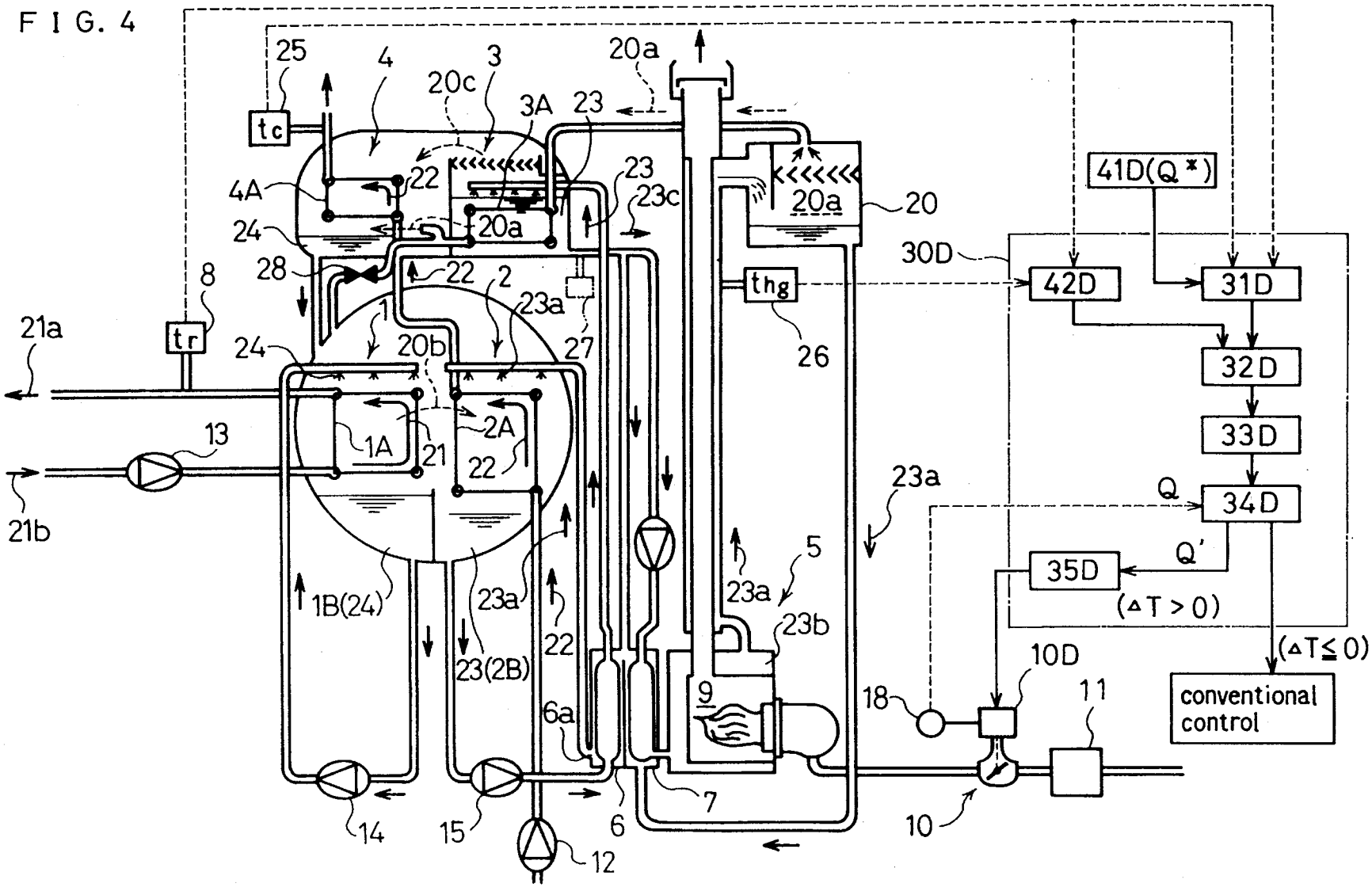
FIG. 4 is a fourth control system diagram of an absorption chiller/heater to which the present invention is applied.

As shown in FIG. 4 control means 30D is provided with memory means 41D for regulating a maximum allowable heating quantity Q* of the generator 5 which is inputted by an operator. The control means 30D is for calculating a maximum allowable difference $(t_{hg}-t_c)^*$ between a temperature $t_{hg}$ of the solution 23*a* heated and concentrated in the generator 5 and an outlet temperature $t_c$ of the cooling water 22 based on a maximum allowable heating quantity Q* of the generator 5 and a difference $t_c-t_r$ between an outlet temperature $t_c$ of the cooling water 22 and an outlet temperature $t_r$ of the chilled water 21*a*, and for adjusting an opening degree of the burning quantity control valve 10 so that a present difference $t_{hg}-t_c$ between a temperature $t_{hg}$ of the solution 23*a* heated and concentrated in the generator 5 and an outlet temperature $t_c$ of the cooling water 22 does not exceed a calculated maximum allowable difference $(t_{hg}-t_c)^*$ thereof.

The control means 30D consists of calculating means 42D for $(t_{hg}-t_c)$, calculating means 31D for $(t_{hg}-t_c)^*$, calculating means 32D for $\Delta T=(t_{hg}-t_c)-(t_{hg}-t_c)^*$, comparator 33D for $\Delta T \leqq 0$ or $\Delta T>0$, calculating means 34D for calculating an aimed value Q' for adjusting the operation by using detected Q when $\Delta T>0$, and for ordering the conventional controlled operation when $\Delta T \leqq 0$ and servo-driver means 35D to the actuator 10D so that the valve 10 is closed according to Q'. The equation for calculating Q' is adopted in the embodiment as follows:

$$Q'=[1-k\cdot\Delta T]\cdot Q$$

where k is constant. This equation means that Q' increases linearly when ΔT decreases.

When $(t_{hg}-t_c)^* \geqq t_{hg}-t_c$, i.e., $\Delta T \leqq 0$, a heating quantity in the heating device 9 is adjusted by subjecting to a proportional control or a PID control which is based on an outlet temperature $t_r$ of the chilled water 21*a* as stated in the paragraph of the background art.

On the other hand when $(t_{hg}-t_c)^*<t_{hg}-t_c$, i.e., $\Delta T>0$, a present heating quantity Q in the heating device 9 is decreased so that a present difference $t_{hg}-t_c)^*$ in becomes less than a suitable difference $(t_{hg}-t_c)^*$ in order to prevent the machine from operating more abnormally. An optimum cooling operation is achieved without wasteful consumption of the heat source in the limited operation range.

In the above mentioned latter three examples, too, temperatures and flow rate of the heat source are sampled every several seconds by temperature sensors 8, 25, 26 and a valve opening detector 18. By means of those detected and measured values, a present heating quantity is adjusted so as to match with the conditions of a desired cooling operation, for example, every two minutes. In the machine which fuel gas or oil is burnt, the combustion thereof in the heating device 9 is adjusted. In the machine to which high temperature steam is supplied the amount of steam fed to the high temperature generator 5 is adjusted.

Any above mentioned control device of four types is applicable to a cycle control of the absorption chiller. Each of them is also applicable not only to a single effect absorption chiller but to a single effect absorption chiller/heater. In the type of such a single effect machine which is not provided with a high temperature generator 5, a temperature sensor 27 shown by double dotted chain lines is provided in the generator 3 or on the pipe through which the concentrated solution 23*c* passes, thereby the temperature $t_{hg}$ of the solution 23*c* is detected. The generator 3 to which high temperature steam is supplied is provided with a steam control valve (not illustrated) and its valve opening detector (not illustrated), and a present heating quantity Q in the generator 3 can be calculated. In any control device it is possible to prevent the heating quantity of the generator from being excessively restricted, in addition, preventing the absorbent from crystallizing at an outlet of the heat exchanger and preventing a part of heating quantity of the generator from being wasted.

Above mentioned equations of (1)', (2)', (3)' and (4)' are thermodynamically supported from heat balance and material balance at an evaporator 1, an absorber 2, a generator 3 and a codenser 4 respectively. Following explanation is based on a single effect absorption chiller in order to easily comprehend.

First, following equation is formulated at an evaporator 1.

$$Q_r = G_r \times (t_{r1} - t_{r2}) = g_1 \times (h_1 - t_{s2}) = K_r \times A_r \left( \frac{t_{r1} + t_{r2}}{2} - t_{s1} \right)$$

where $Q_r$ is heat capacity of the evaporator, $G_r$ [kg/h] is a flow rate of the chilled water, $t_{r1}$ [°C.] is an inlet temperature of the chilled water, $t_{r2}$[°C.] is an outlet temperature of the chilled water, $g_1$[kg/h] is a flow rate of the circutating refrigerant, $h_1$ is an enthalpy of saturated vapor of the refrigerant, $t_{s1}$[°C.] is an evaporized temperature of saturated vapor of the refrigerant, $t_{s2}$[°C.] is a condensized temperature of saturated vapor of the refrigerant, $K_r$ is rate of heat transfer at the evaporator and $A_r$[m$^2$] is a heat transfer area of the evaporator.

A following equation is obtained from above equation:

$$t_{r1} - t_{s1} = (h_1 - t_{s2}) \times \frac{g_1}{G_2} \left( \frac{G_2}{K_r \times A_r} + \frac{G_2}{2\,G_r} \right),$$

where $G_2$[kg/h] is a flow rate of the circutating dilute solution.

A term of heat transfer is placed to $$Y_r = \frac{G_2}{K_r \times A_r} + \frac{G_2}{2\,G_r}.$$

Above mentioned $h_1$–$t_{s2}$ is approximately equal to constant $K_{h1}$ because that $h_1$ is much larger than $t_{s2}$, and $t_{r1}$ does not varies so much, therefore, $$t_{r1} - t_{s1} = K_{h1} \times \frac{g_1}{G_2} \times Y_r = f_e \left( \frac{g_1}{G_2}, Y_r \right).$$

Similarly, following equations are expressed at a generator 3, a heat exchanger 6, an absorber 2 and a condenser 4. An equation of the generator is;

$$T_4 - T_3 = f_g \left( \frac{g_1}{G_2}, \frac{Q_f}{G_2} \right),$$

where $T_4$ [°C.] is an outlet temperature of the condensed solution flowed from the generator 3, $T_3$ [°C.] is an inlet temperature of dilute solution flowed into the generator 3 and $Q_f$ is a heat quantity of the generator 3.

An equation of the heat exchanger is;

$$T_1 - T_2 = f_{h1} \left( \frac{g_1}{G_2}, T_4 - T_3, Y_L \right),$$

$$T_4 - T_2 = f_{h2} \left( \frac{g_1}{G_2}, T_1 - T_2, Y_L \right)$$

where $T_1$ [°C.] is an inlet temperature of the condensed solution flowed into the absorber 2, $T_3$[°C.] is an outlet temperature of the dilute solution flowed from the absorber 2 and $Y_L$ is a term of heat transfer at the heat exchanger.

An equation of the absorber is;

$$T_2 - t_{c1} = f_a \left( \frac{g_1}{G_2}, T_1 - T_2, Y_A \right)$$

where $t_{c1}$ [°C.] is an inlet temperature of the cooling water, $Y_A$ is a term of heat transfer at the absorber.

An equation of the condenser is;

$$t_{s2} - t_{c1} = f_c \left( \frac{g_1}{G_2}, T_1 - T_2, Y_C, \frac{G_2}{G_C} \right)$$

where $G_r$ [kg/h] is a flow rate of the cooling water and $Y_c$ is a term of heat transfer at the condenser.

An equation of concentration $z_1$ of the dilute solution is;

$$z_2 = f_{z2}(T_2 - T_{c1}, t_{r1} - t_{s1}, t_{c1} - t_{r1}).$$

An equation of concentration $z_1$ of the condensed solution is;

$$z_1 = f_{z1}\,(T_4 - T_2, T_2 - t_{c1}, t_{c1} - t_{s2}).$$

An equation of material balance is;

$$g_1/G_2 = 1 - \frac{z_2}{z_1}$$

From above mentioned equations in an absorption chiller effective variables on cooling cycle characteristic are chosen from equations $f_e$, $f_g$, $f_{h1}$, $f_{h2}$, $f_a$, $f_c$, $f_{z1}$ and $f_{z2}$ as follows:

$$Q_f,\ t_{c1} - t_{r1},\ T_4 - t_{c1}$$

$T_4$–$t_{c1}$ does not directly appear in equations, but since it is equal to $(T_4 - T_1) + (T_2 - t_{c1})$, $T_4$–$t_{c1}$ is also effective variable.

The variables of $Q_f$, $t_{c1}$–$t_{r1}$, $T_4$–$t_{c1}$ are found such an above mentioned manner, equation (1)', (2)', (3)' and (4)' are comprehended to be theoretically supported.

In addition to the above mentioned control a machine is safely available under following three kind of restricted controls so as not to enter over-rated operation.

(1) In case that an inlet temperature $t_{c1}$ of the cooling water is more than a rated temperature thereof a rated one is replaced to the value of $t_{c1}$. Thereby even if an inlet temperature of the cooling water comes to over-rated one, it is controlable so that a temperature $t_{hg}$ of the concentrated solution does not increase more than a rated one.

(2) In case that an outlet temperature $t_{r2}$ or an inlet temperature $t_{r1}$ of the chilled water is less than a rated temperature thereof a rated one is replaced to the value of $t_{r2}$ or $t_{r1}$, because of similar reason of (1).

(3) In case that an outlet temperature $t_{r2}$ or an inlet temperature $t_{r1}$ of the chilled water is +5° C. higher than a rated temperature thereof it is controlled so as to keep a detected temperature. Thereby a temperature $t_{hg}$ of the concentrated solution is not over-estimated even if a temperature of the chilled water is excessively high.

According to the present invention the crystallized absorbent in the concentrated solution never chokes the outlet of the heat exchanger. Even when the conditions of cooling operation of the machine are changed, the heating quantity suitable for the operating conditions thereof is obtainable in the generator. Since the generated refrigerant does not directly return to the solution, the whole of heating quantity consumed for generating refrigerant is effective for the cooling operation.

For example, what a temperature of the chilled water becomes higher than an aimed temperature thereof in spite that a temperature of the cooling water is desirably low means an abnormal operation of the machine. In such a case it is necessary to repair the machine, but it is favorable to continue an abnormal operation when an air-condition is requred even if not enough. This invention enables to control the machine so that concentrated solution does not crystallized at an outlet of a low temperature heat exchanger under a provisional and abnoamal operation thereof.

In this disclosure, there are shown and described only the preferred embodiments of the invention, but, as aforementioned, it is to be understood that the invention is capable of use in various other combinations and environments and is capable of changes or modifications within the scope of the inventive concept as expressed herein.

What is claimed is:

1. A control device for controlling a chiller or an absorption chiller/heater during a cooling operation by which chilled water is obtained by vaporizing a refrigerant separated from a solution during repeated concentration and dilution of the solution which is circulated through a system comprising an evaporator, an absorber, a generator and a condenser, the control device comprising:

first temperature sensing means for sensing a temperature of heated and concentrated solution in the generator;

second temperature sensing means for sensing a selected one of an inlet or an outlet temperature of a flow of chilled water flowed into or from the evaporator;

third temperature sensing means for sensing a selected one of an inlet or an outlet temperature of a flow of cooling water at a location between the absorber and the condenser;

a control valve for controlling a flow of a fuel burned to provide a controlled heat input to the generator;

detector means for sensing an opening degree of the control valve to determine a corresponding heat input to the generator; and means for determining a maximum allowable value of the heat input to the generator based on said sensed temperature of the heated solution, said selected one of the inlet or outlet temperature of the chilled water flow and said selected one of the inlet or outlet temperature of the cooling water flow, and for adjusting an opening degree of the control valve so that said heat input to said generator does not exceed said maximum allowable value thereof.

2. A control device for controlling a chiller or an absorption chiller/heater during a cooling operation by which chilled water is obtained by vaporizing a refrigerant separated from a solution during repeated concentration and dilution of the solution which is circulated through a system comprising an evaporator, an absorber, a generator and a condenser, the control device comprising:

first temperature sensing means for sensing a temperature of heated and concentrated solution in the generator;

second temperature sensing means for sensing a selected one of an inlet or an outlet temperature of a flow of chilled water flowed into or from the evaporator;

third temperature sensing means for sensing a selected one of an inlet or an outlet temperature of a flow of cooling water at a location between the absorber and the condenser;

a control valve for controlling a flow of a fuel burned to provide a controlled heat input to the generator;

detector means for sensing an opening degree of the control valve to determine a corresponding heat input to the generator;

memory means for regulating a maximum allowable value of the heat input to said generator; and means for determining a maximum allowable value of the temperature of the solution heated and concentrated in the generator based on said maximum allowable heat input value, said selected ones of said inlet or outlet temperatures of the chilled water and said inlet or outlet temperatures of the cooling water, and for adjusting an opening degree of the control valve so that the temperature of solution heated and concentrated in said generator does not exceed said maximum allowable value of the temperature thereof.

3. A control device for controlling chiller or an absorption chiller/heater during a cooling operation by which chilled water is obtained by vaporizing a refrigerant separated from a solution during repeated concentration and dilution of the solution which is circulated through a system comprising an evaporator, an absorber, a generator and a condenser, the control device comprising:

first temperature sensing means for sensing a temperature of heated and concentrated solution in the generator;

second temperature sensing means for sensing a selected one of an inlet or an outlet temperature of a flow of chilled water flowed into or from the evaporator;

third temperature sensing means for sensing a selected one of an inlet or an outlet temperature of a flow of cooling water at a location between the absorber and the condenser;

a control valve for controlling a flow of a fuel burned to provide a controlled heat input to the generator;

detector means for sensing an opening degree of the control valve to determine a corresponding heat input to the generator; and means for calculating a maximum allowable value of the heat input based on a difference between said temperature of the solution and said selected ones of said inlet or outlet temperatures of the cooling water and a difference between the selected one of said inlet or outlet temperatures of the cooling water and a corresponding selected one of said inlet or outlet temperatures of the chilled water, and for adjusting an opening degree of the control valve so that said heat input to said generator does not exceed said calculated maximum allowable value thereof.

4. A control device for controlling a chiller or an absorption chiller/heater during a cooling operation by which chilled water is obtained by vaporizing a refrigerant separated from a solution during repeated concentration and dilution of the solution which is circulated through a system comprising an evaporator, an absorber, a generator and a condenser, the control device comprising:

first temperature sensing means for sensing a temperature of heated and concentrated solution in the generator;

second temperature sensing means for sensing a selected one of an inlet or an outlet temperature of a flow of chilled water flowed into or from the evaporator;

third temperature sensing means for sensing a selected one of an inlet or an outlet temperature of a flow of cooling water at a location between the absorber and the condenser;

a control valve for controlling a flow of a fuel burned to provide a controlled heat input to the generator;

detector means for sensing an opening degree of the control valve to determine a corresponding heat input to the generator; and memory means for regulating a maximum allowable value of the heat input to said generator;

means for calculating a maximum allowable value of the difference between said the temperature of the solution heated and concentrated in the generator and said selected one of said inlet or outlet temperatures of the cooling water based on said maximum allowable value of said heat input to said generator and a difference between said selected one of said inlet or outlet temperatures of the cooling water and a corresponding selected one of said inlet or outlet temperatures of chilled water, and for adjusting an opening degree of the burning quantity control valve so that a difference between said temperature of the solution heated and concentrated in the generator and said selected one of said inlet or outlet temperatures of the cooling water does not exceed said calculated maximum allowable difference thereof.

* * * * *